United States Patent [19]

Platt et al.

[11] 4,234,082

[45] Nov. 18, 1980

[54] TWO-WAY CONTAINER PACKAGE

[75] Inventors: John R. Platt, Wheaton; Edward L. Benno, Grayslake, both of Ill.

[73] Assignee: Illinois Tool Works Inc., Chicago, Ill.

[21] Appl. No.: 31,565

[22] Filed: Apr. 19, 1979

[51] Int. Cl.[3] ..... B65D 77/00
[52] U.S. Cl. ..... 206/150; 206/216
[58] Field of Search ..... 206/223, 216, 150

[56] References Cited

U.S. PATENT DOCUMENTS

| | | | |
|---|---|---|---|
| 3,703,956 | 11/1972 | Oswalt | 206/223 |
| 4,098,398 | 7/1978 | Meyers | 206/223 |

*Primary Examiner*—Joseph Man-Fu Moy
*Attorney, Agent, or Firm*—Thomas W. Buckman

[57] ABSTRACT

A package for a plurality of can-like containers which includes a primary package making device, such as a thermoplastic sheet carrier device, and a plastic bag retained in the primary package adapted to form a secondary package for the containers when they have been emptied.

3 Claims, 6 Drawing Figures

TWO-WAY CONTAINER PACKAGE

BACKGROUND AND SUMMARY OF THE INVENTION

This invention relates generally to a package for a plurality of can containers which includes features permitting the containers to be repackaged for return once they have been emptied.

The art of packaging containers, such as cans, has been developed to the extent that an efficient and economical package is generally available to consumers, such as the traditional "six-pack". These packages typically are created by a thermoplastic carrier device. However, if the consumer wants to repackage these containers when they have been emptied to an effort to redeem a deposit, avoid litter or the like there is no convenient, readily available means for him to do so.

Accordingly, it is an object of the invention to provide a primary package consisting of a plurality of can-like containers retained by a primary packaging device and further including a discrete plastic bag member temporarily secured to or within the primary package. The plastic bag, being discrete and separable from the primary package, will thus serve as a secondary package device and will be dimensioned so that all of the containers packaged in the primary package can be inserted and retained in the plastic bag for convenient storage and eventual return for disposal of the containers.

Other objects, uses and advantages of the invention will be apparent from a reading of this description and the preferred embodiments recited therein and with reference to the accompanying drawings in which:

DETAILED DESCRIPTION OF THE PREFERRED EMBODIMENTS

Figure 1:
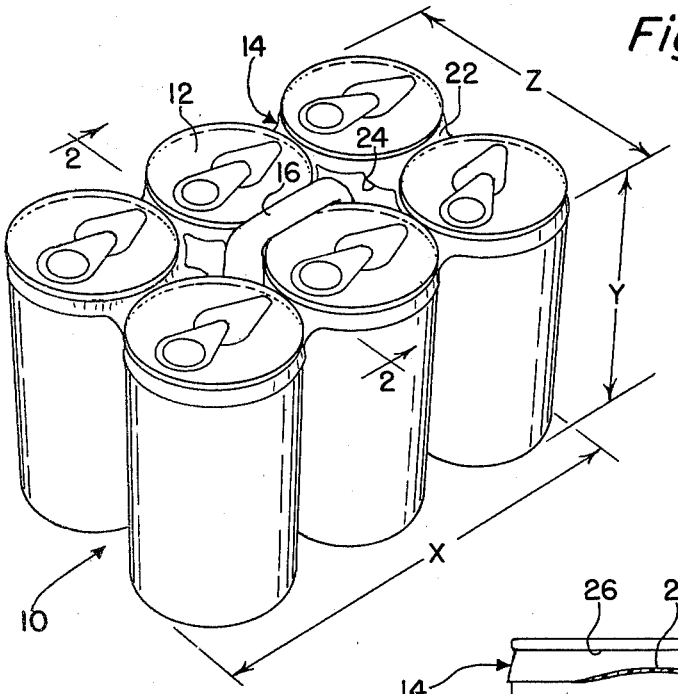
FIG. 1 is a perspective view of one embodiment of the invention illustrating a primary package incorporating all of the features of the invention including a secondary package making device.

Turning to FIG. 1, a primary package 10 is illustrated which incorporates all of the features of the invention. Primary package 10 basically includes a plurality of can-like containers 12 being secured and packaged together by means of a thermoplastic sheet carrier device 14. This embodiment shows six such containers arranged in rows and ranks in a typical "six-pack" fashion. The carrier, in a manner typical of such a carrier, includes a pair of spaced finger hole apertures 24. It should be noted that a discrete elongated, compacted member 16 is secured to the package by inserting each longitudinal extremity of this rolled or compacted member into each of the finger apertures. This member 16 is, as will be described in more detail, a plastic bag which will serve as a secondary package for containers.

For purposes of illustration, the primary package 10 will be described as having dimensions X, Y and Z. In a typical "six-pack" of 12 oz. cans, these dimensions will be about 8 inches, $4\frac{2}{3}$ inches, and $5\frac{1}{3}$ inches, respectively. Of course, this invention is in no way limited to these dimensions, but only serves as illustration of a typical package which may be created by the invention.

Carrier device 14 may be referred to as a primary package making device and is shown herein as a sheet of thermoplastic-type creating container encircling resilient bands 20 which are interconnected integrally by web means 22. The bands are positioned near the top of the containers and beneath chimes 26 formed by the perimeter of the lids. Of course, it should be understood that this type of carrier device is illustrative of a typical primary packaging means and the total invention contemplated may also contemplate various embodiments or styles of such carrier devices which essentially serve the same purpose. For example, the package may contain other numbers of containers, such as 8 or 12 containers.

Figure 2:
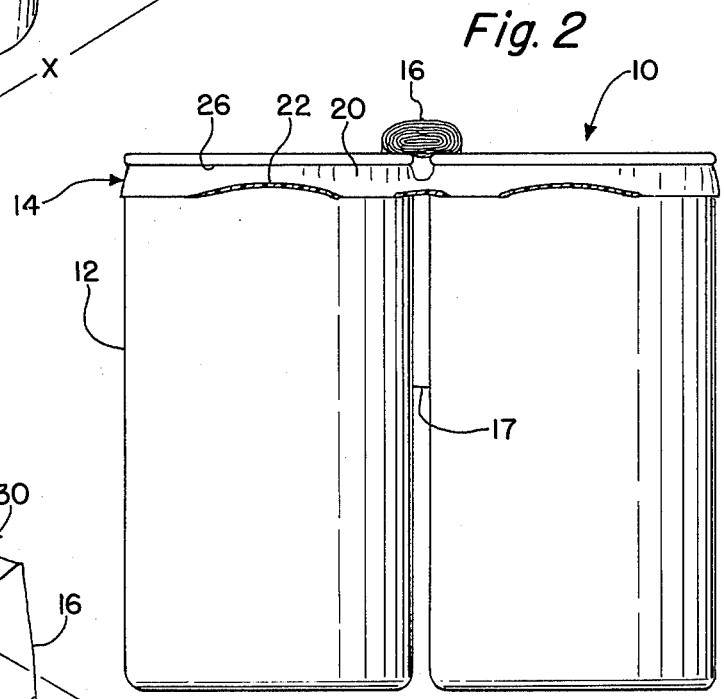
FIG. 2 is a sectional view of the primary package of FIG. 1 as taken along lines 2—2 of FIG. 1.
Figure 3:
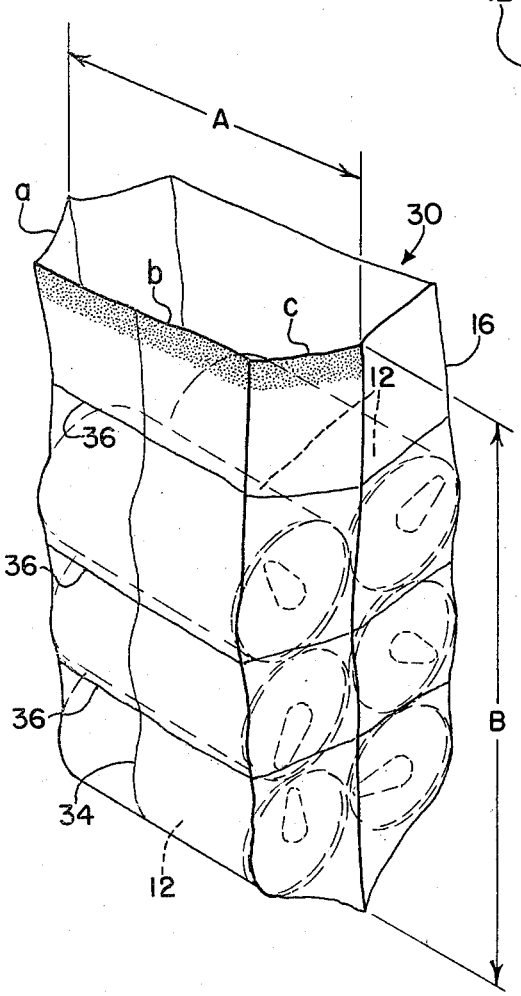
FIG. 3 is a perspective view of a secondary package created by various embodiments of the invention.

Turning more particularly to FIGS. 2 and 3, it will be shown that the bag 16 is preferably a clear plastic bag having a volume and dimensions sufficient to retain all of the containers 12 incorporated in the primary package. It is even preferable that the length dimension of the bag be sufficient to permit the top of the bag to be secured or closed in some manner, such as by wire ties or tying the bag itself. The embodiment of the invention described in FIGS. 1 and 2 incorporates the bag being tightly folded, compacted and rolled into an elongated member 16. The extremities 17 of the member 16 are then inserted into the pair of apertures 24 and temporarily retained thereby. The rolled bag 16 will have a cross-sectional area sufficient to enter holes 24 and be retained therein. The middle sections of the bag member 16, when in the primary package mode, thus rests on the top of the primary carrier over one of the web means 22 of carrier device 14. The placement of the ends of this bag into the finger holes would not detract from the use of these finger holes as a carrying means for the primary package.

Alternatively, the ends of the elongated rolled or folded bag 16 can be releasably secured to the carrier device 14 to produce a bail handle as part of the primary package.

When the containers have been emptied, the bag 16 thus serves as a secondary package 30 as shown in FIG. 3. For purposes of illustration, the bag should have lay-flat dimensions sufficient to enable all of the containers 12 to be inserted therein. For example, the lay-flat width of "A" which would be the total of the width dimensions of panels "a", "b" and "c" may be approximately 12 inches when the above described containers are utilized. The length dimension "B" may, accordingly, be between 10 and 12 inches to provide sufficient volume in the bag to receive all the containers 12 and yet permit the bag to be secured.

Figure 4:
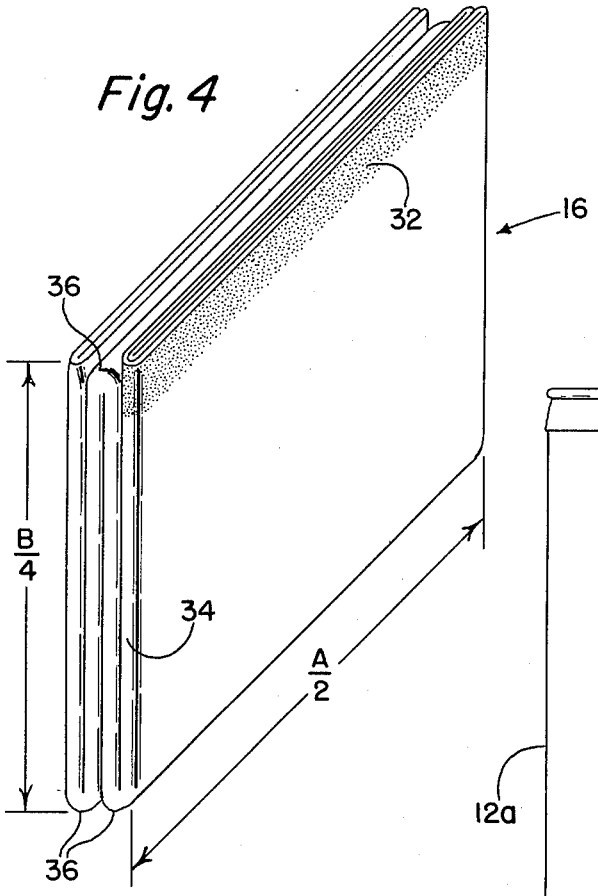
FIG. 4 is a slightly enlarged perspective view of a folded bag which may be utilized in the primary packages of the invention.

Discrete plastic bag 16 should be tightly compacted and folded to be temporarily secured to and form part of the primary package. With this in mind, a bag having the above-noted lay-flat dimensions A,B may be folded longitudinally, as along fold line 34 and laterally along a plurality of fold lines 36. For example, in FIG. 4, such a folded bag will have had a width dimension substantially equal to B/4 and a length dimension substantially equal to A/2 relative to the original lay-flat dimensions coordinated to accept containers of a predetermined dimension. The thus folded or compacted bag can thereafter be rolled about a longitudinal axis and inserted into the apertures of the containers to create primary package 10.

Figure 5:
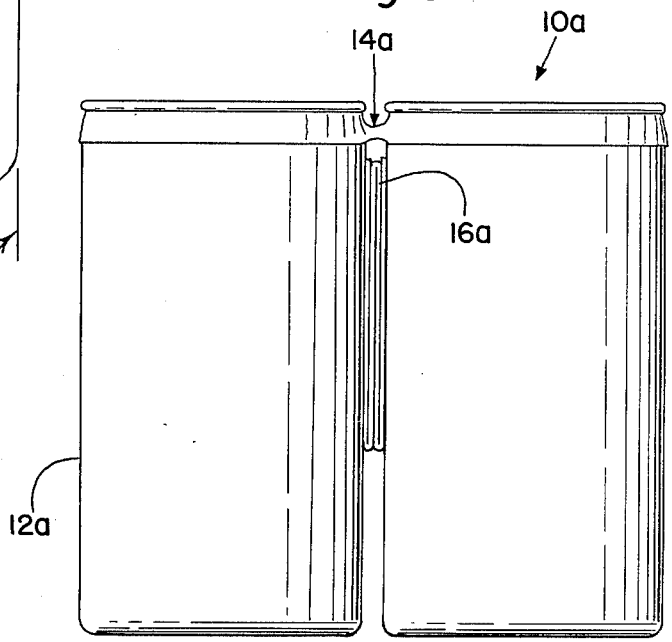
FIG. 5 is an end view of a primary package of another embodiment of the invention.
Figure 6:
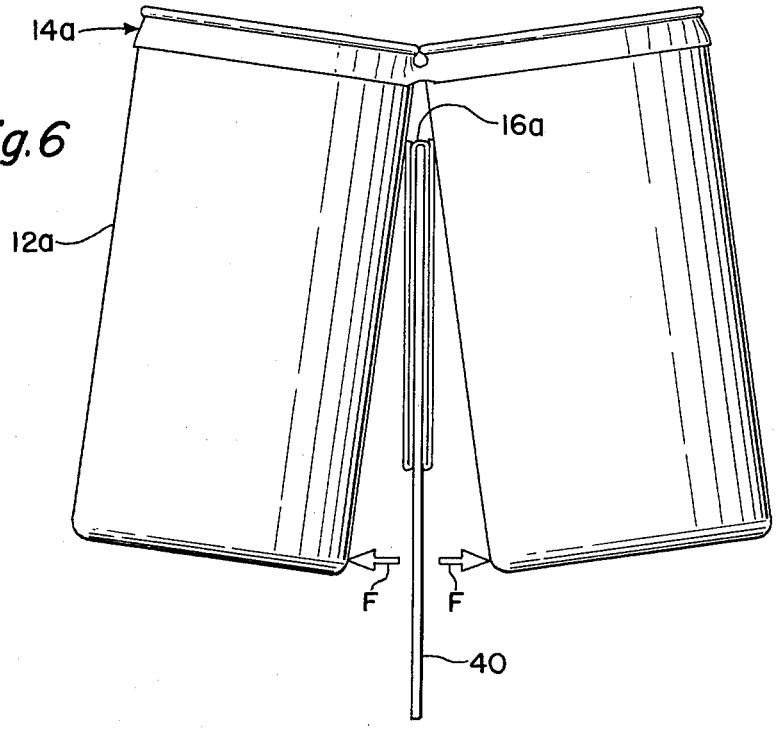
FIG. 6 is an end view illustrating a manner of inserting the bag in the package shown in FIG. 5.

The basic features of the invention, however, may be incorporated in embodiments other than that shown in FIG. 1. For example, in FIGS. 5 and 6, a primary package 10*a* which will consist of a plurality of containers 12*a* retained in a primary packaging device 14*a* and having discrete bag 16*a* temporarily retained therein. A bag 16*a* similar to that described in FIGS. 1–4 may be inserted between rows or ranks of primary package 10*a* and snugly secured thereby. For example, in FIG. 5, the folded and compacted bag shown in FIG. 4 may be inserted between the rows of containers 12*a*. With such an embodiment it may be desirable to coat the top edge of the bag with a strip of adhesive 32 to more reliably secure the bag when it is wedged between the rows of containers. The bag 16*a* will be properly dimensioned in the folded condition of FIG. 4 to be essentially retained totally within the perimeter of primary package 10*a*.

One method of producing such a primary package 10*a* would involve the positionment of a primary carrier device 14*a* over the tops of the containers 12*a* and beneath the chimes of the containers in a manner which is known, thereafter slightly spreading the bottoms of the containers apart by a force F while the tops are retained by device 14*a*. In this spread configuration shown in FIG. 6, the bag 16*a* may then be wedged upwardly as by a blade 40. The containers then freely tilt back and the secondary package making bag 16*a* will then be temporarily retained in the primary package. After the containers have been emptied, bag 16*a* serves as a secondary package identical to that shown in FIG. 3. The container spreading means need not be an instrument separate from the bag 16*a* carried on the blade 40 but can be these elements.

While certain forms of the invention have been shown for purposes of illustration, it is understood that various changes in details of construction, dimensions and arrangement of elements may be made without departing from the true scope of an invention which incorporates in a primary package a discrete member which will create in turn a secondary package.

We claim:

1. In a carrier package for containers or the like which includes features permitting the formation of a secondary package of said containers when their contents have been removed, the combination of a plurality of containers and a carrier device retaining said containers in a primary package configuration relative to each other, a plastic bag having a volume capacity not less than the total volume of said plurality of containers and of internal dimension sufficient to accept and retain all of said plurality of containers and to permit said bag to be closed with said plurality of containers retained therein, and said plastic bag in an empty collapsed condition releasably carried in said primary package, said carrier is provided with a pair of spaced finger hole means, said plastic bag being collapsed into a narrow and elongated configuration with each longitudinal extremity thereof being inserted into an associated finger hole.

2. The carrier package of claim 1, wherein said bag is releasably secured to said carrier in the arrangement of a bail handle.

3. A package for can-type containers including, in combination, a primary package forming device temporarily retaining a plurality of cylindrical can-type containers together for handling said plurality of containers in filled condition, a discrete plastic bag having a volume capacity greater than the total volume of said plurality of containers, said discrete plastic bag also being dimensioned to receive and retain all of said plurality of containers thereby creating a secondary package forming device for retaining and handling said plurality of containers in empty condition, spaced finger hole apertures formed in said primary package device, said discrete plastic bag being compacted and rolled into an elongated configuration with a predetermined cross-sectional area, the longitudinal extremities of said elongated, rolled bag each being inserted into and retained by said finger hole apertures with the central region of said elongated, rolled bag juxtaposed on top of the region of the primary package forming device intermediate the apertures.

* * * * *